United States Patent [19]

Becka

[11] 4,155,135

[45] May 22, 1979

[54] PULLING OVER MECHANISM

[75] Inventor: Michael M. Becka, Nashua, N.H.

[73] Assignee: International Shoe Machine Corporation, Nashua, N.H.

[21] Appl. No.: 905,683

[22] Filed: May 15, 1978

[51] Int. Cl.[2] ..... A43D 23/00

[52] U.S. Cl. ..... 12/14.5

[58] Field of Search ..... 12/9, 10, 10.1, 10.2, 12/10.4, 10.5, 14.5, 145

[56] References Cited

U.S. PATENT DOCUMENTS

| | | | |
|---|---|---|---|
| 3,099,846 | 8/1963 | Lane et al. | 12/10.1 |
| 3,157,897 | 11/1964 | Morrill | 12/10.5 |
| 3,233,261 | 2/1966 | Kamborian et al. | 12/10.5 |

*Primary Examiner*—Patrick D. Lawson
*Attorney, Agent, or Firm*—Albert Gordon

[57] ABSTRACT

A pulling over mechanism having pincers for gripping the margin of an upper mounted on a last for stretching the upper about the last pursuant to relative heightwise movement of the last with respect to pincers. A motor is actuable to move the pincers heightwise and a handle is so connected to the pincers as to lower the pincers in response to movement of the handle and to thereafter be disconnected from the pincers.

4 Claims, 12 Drawing Figures

PULLING OVER MECHANISM

BACKGROUND OF THE INVENTION

There is currently marketed a prior art pulling and lasting machine Model SG which is distributed in the United States by the Machinery Division of the USM Corporation of Beverly, Mass. The SG machine incorporates a plurality of pincers wherein each pincers is mounted for heightwise movement between upper and lower positions. Powered means effect this heightwise movement. The powered means are initially caused to retain the pincers in their upper positions in which positions the pincers grip the margin of an upper mounted on a last and stretch the toe portion of the upper about the last pursuant to upward movement of the last. A handle for each pincers is so mounted in the machine as to be movable away from an idle position. Each handle is so connected to a pincers as to cause its associated pincers to be lowered from its upper position to an intermediate position in response to movement of the handle from its idle position to an advanced position, the distance between the pincers upper position and the pincers intermediate position being proportional to the extent of movement of the handle away from its idle position to its advanced position. Retaining means are provided that enable the pincers to be retained in its intermediate position upon release of the handle in its advanced position. The purpose of moving selected pincers to their intermediate positions by moving corresponding handles to their advanced position is to reposition the upper about the last if it is not properly positioned in the last when the upper is stretched about the last so as to properly orient the upper on the last for a subsequently performed wiping operation as explained in U.S. Pat. Nos. 3,157,897 and 3,233,261. After the selected pincers have been so moved by the handles, wipers are caused to move through a wiping stroke to wipe the margin of the toe portion of the upper against an insole located on the bottom of the last as disclosed in U.S. Pat. Nos. 3,157,897 and 3,233,261. Prior to the completion of the wiping stroke, all of the pincers are caused to release the upper margin and all of the pincers are lowered to their lower positions out of the path of the incoming wipers. The wipers are then retracted and the pincers are raised to their upper positions in readiness for the next machine cycle.

SUMMARY OF THE INVENTION

In the operation of the Model SG machine, as described above, the movement of each pincers between its upper and lower positions causes corresponding movement of its associated handle through a relatively great distance regardless of whether a handle is manipulated to cause its associated pincers to reposition the upper about the last. Aside from being unsightly, these useless movements of the handles are potentially dangerous in that they can strike against a part of the operator's body and injure the operator. In order to overcome this problem, the improved machine, in accordance with this invention, provides a releasable connection between each handle and its associated pincers which connection is released after the handle has been moved from its idle position to its advanced position to thereby move its associated pincers from its upper position to its intermediate position and by providing a return means to return the handle to its idle position after the connection has been released. As a result, each handle moves a relatively short distance only if it is used to lower its associated pincers.

DESCRIPTION OF THE PREFERRED EMBODIMENT

Figure 1:
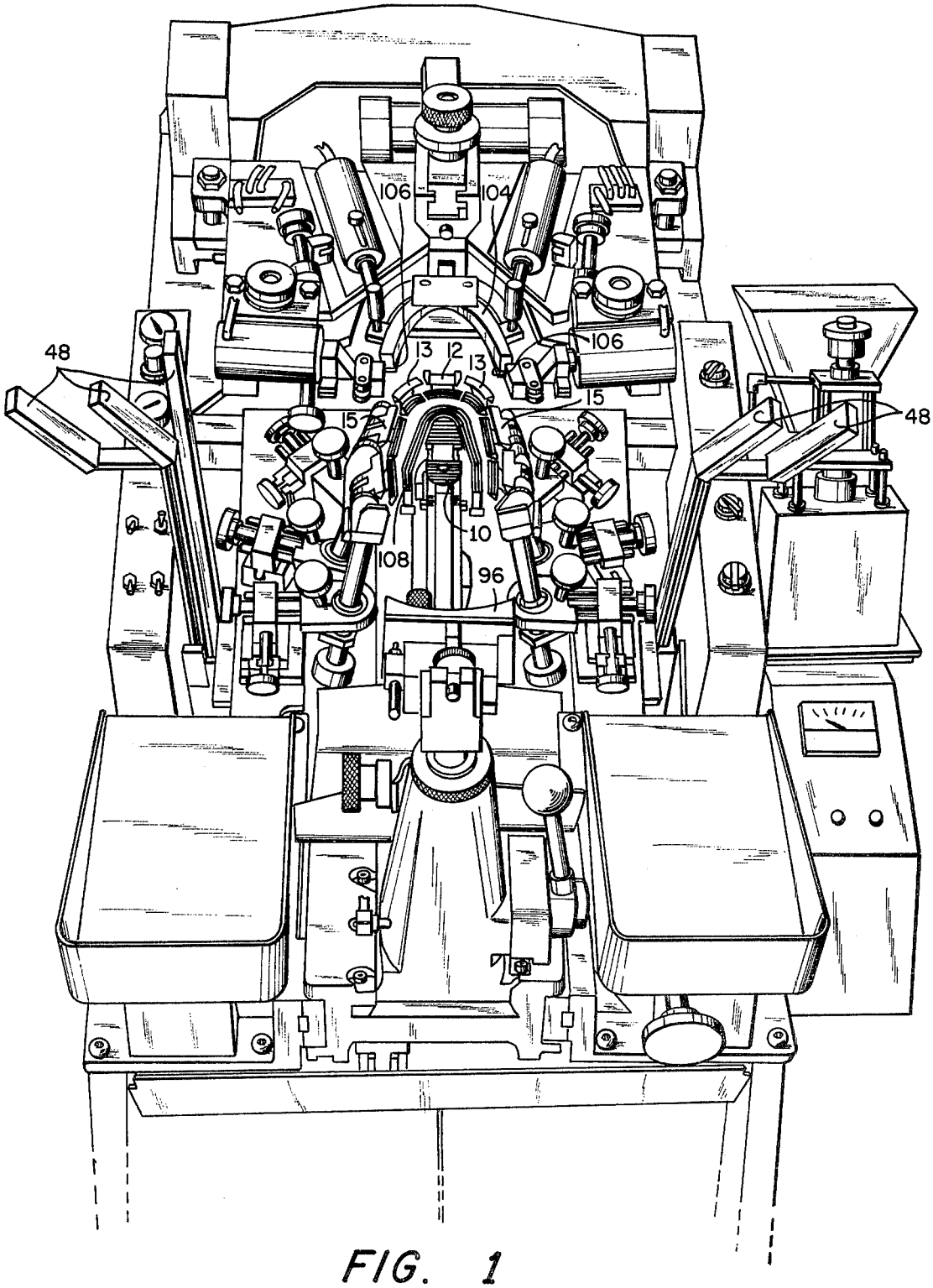
FIG. 1 is a front elevation of a machine incorporating this invention.

The operator is intended to face the machine as seen in FIG. 1. Machine parts closest to the operator are considered to be their fronts and machine parts furthermost from the operator are considered to be their backs. Directions moving toward the operator are considered to be "forward" and directions moving away from the operator are considered to be "rearward".

Referring to FIG. 1, the machine includes an insole rest 10. A toe pincers assembly 12 is located rearwardly of the insole rest 10 and side pincers assemblies 13 and 15 are located on each side of the insole rest 10 forwardly of and on each side of the toe pincers assembly 12. The side pincers assemblies 13 which are the rearmost side pincers assemblies closest to the toe pincers assembly 12 are corner pincers assemblies. The side pincers assembly 15, which are forward of the corner pincers assemblies 13, are forepart pincers assemblies.

Figure 2:
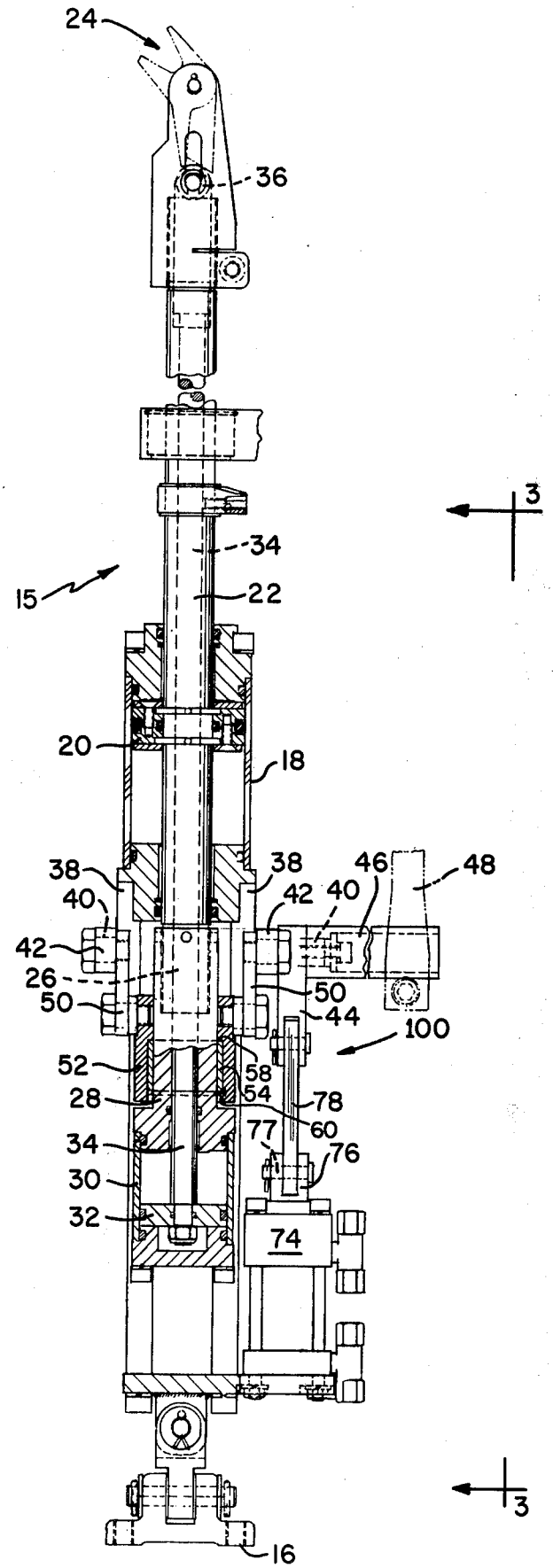
FIG. 2 is a partially sectional elevation of a pincers assembly in the machine.
Figure 3:
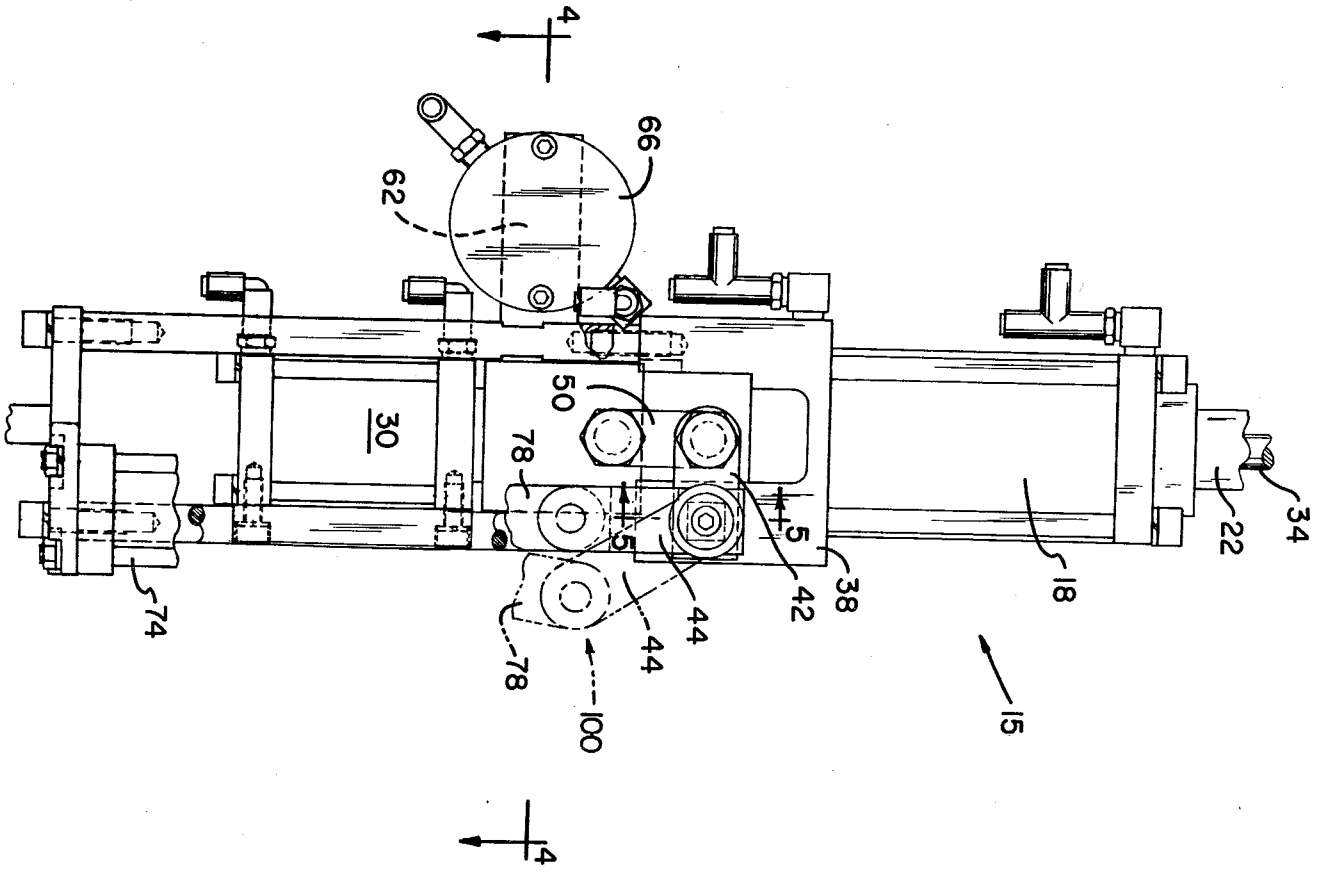
FIG. 3 is a view taken along the line 3—3 of FIG. 2.
Figure 4:
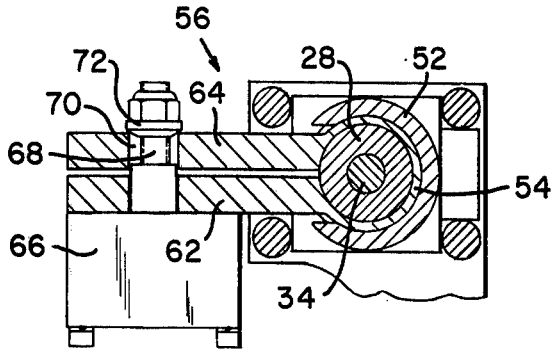
FIG. 4 is a section taken along the line 4—4 of FIG. 3.
Figure 5:
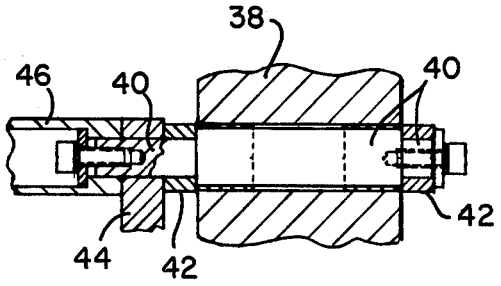
FIG. 5 is a section taken along the line 5—5 of FIG. 3.

Referring to FIGS. 2 and 3, each pincers assembly is mounted to a base plate 16. An air actuated motor 18, on each pincers assembly, incorporates a piston 20 mounted for heightwise movement. Each piston 20 is affixed to a sleeve 22 also mounted for heightwise movement, and each sleeve 22 is mounted to a pincers 24 formed of a pair of relatively movable jaws whereby heightwise movement of a piston 20 causes corresponding movement of its associated pincers 24. The bottom of each sleeve 22 is secured by a threaded connection 26 to a post 28 and the bottom of each post 28 forms the top portion of an air actuated motor 30 whereby each motor 30 is mounted to its associated pincers assembly for heightwise movement in unison with its associated sleeve 22. Each motor 30 incorporates a piston 32 and each piston 32 is affixed to a shaft 34 that is slidably mounted for heightwise movement within its associated post 28 and sleeve 22. A cam roll 36 on the top of each shaft 34 is adapted to close the normally open jaws of its associated pincers 24 in response to upward movement of its assoicated shaft 34 in the manner described in U.S. Pat. No. 3,902,211.

FIGS. 2 and 3 show a forepart pincers assembly 15 incorporating a pincers adjusting mechanism described below. This pincers adjusting mechanism is incorporated in both forepart pincers assemblies 15, both corner pincers assemblies 13, and the toe pincers assembly 12.

Referring to FIGS. 2–5, each pincers adjusting mechanism comprises a housing 38 mounted to its associated pincers assembly. A pin 40 is rotatably mounted in the housing 38. Links 42 extend laterally of the pin 40 on opposite sides of the housing 32 and a link 44 extends downwardly of the pin 40 outwardly of one of the links 42. A bar 46 extends laterally of the pin 40 and outwardly of the link 44. The pin 40, the links 42 and 44, and the bar 46 are so connected to each other as to enable them to rotate in unison about the axis of the pin 40 in response to rotation of the pin 40 about its axis in the housing 38. To effect this rotation of the pin 40, a handle 48 (FIGS. 1 and 2) is affixed to each bar 46. As shown in FIG. 1, there are five handles 48, one handle for each of the two forepart pincers assemblies 15, one handle for each of the two corner pincers assemblies 13, and one handle for the toe pincers assembly 12. A link 50 is so pivoted to the end of each link 42 that is remote from the pin 40 as to extend downwardly of its associated link 42. The bottoms of the links 50 are pivoted to a sleeve 52 that is mounted for heightwise movement in its associated post 28. An annulus 54 of a brake 56 (FIGS. 2 and 4) is mounted for heightwise movement on the post 28 and is located between a shoulder 58 and a retaining ring 60 on the sleeve 52 so that the brake 56 and the sleeve 52 may move heightwise in unison on the post 28. Two resilient legs 62 and 64 of the brake 56 extend outwardly of the annulus 54. The legs 62 and 64 are so constructed as to be resiliently urged away from each other. An air operated motor 66, mounted to the leg 62, has a piston rod 68 that extends through the leg 62 and an opening 70 in the leg 64. A cam 72, having a larger diameter than the diameter of the opening 70, is mounted to the piston rod 68 and is located outwardly of the leg 64. An air operated motor 74 (FIG. 2), mounted to the bottom of the pincers assembly, has an upwardly directed piston rod 76 that is pivoted by a pin 77 to a link 78. The top of the link 78 is pivoted to the bottom of the link 44.

Figure 6:
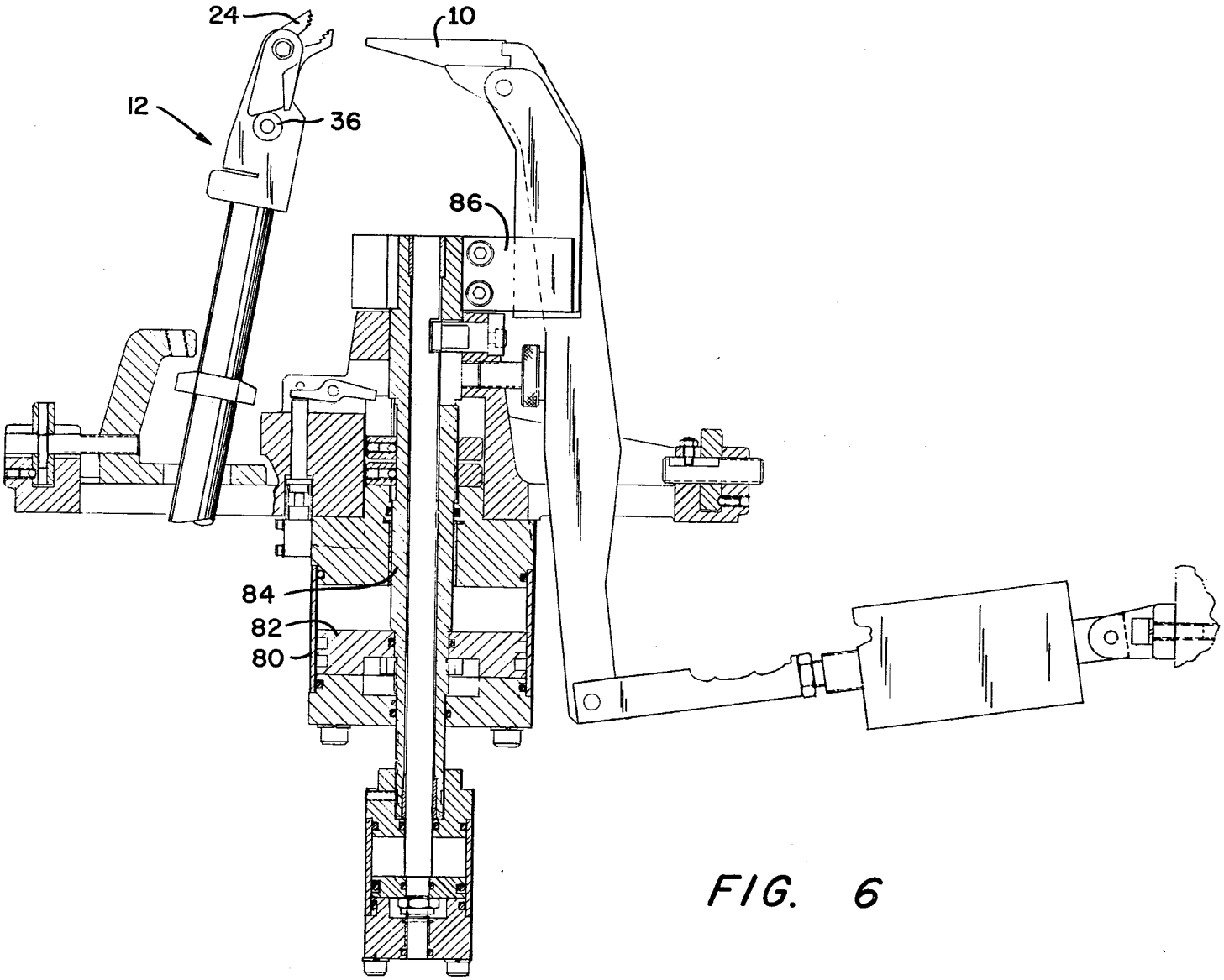
FIG. 6 is a partially sectional elevation of an insole rest and its moving means that are incorporated in the machine.

Referring to FIG. 6, an air operated motor 80, fixed to a stationary part of the machine, has a heightwise movable piston 82. The piston 82 is affixed to a sleeve 84 that, in turn, is affixed at its upper end to a collar 86. The insole rest 10 is affixed to the collar 86 whereby heightwise movement of the piston 82 causes corresponding heightwise movement of the insole rest 10.

In the idle condition of the machine: the pistons 20 of all of the motors 18 are in their raised positions shown in FIG. 2 so that the pincers of all of the pincers assemblies 12, 13, and 15 are in raised positions; the pistons 32 of all of the motors 30 are in their lowered positions, shown in FIG. 2, so that the pincers 24 of all of the pincers assemblies 12, 13, and 15 are open; the piston rod 68 is projected out of the motor 66 so that the legs 62 and 64 are resiliently urged apart with the leg 64 bearing against the cam 72 to thereby maintain the brake 56 open to permit relative heightwise movement between the sleeve 52 and the post 28; the piston rod 76 is retracted into the motor 74 so that the links 44 and 78 are in alignment; and the piston 82 is in its lowered position in the motor 80, as shown in FIG. 6, so that the insole rest 10 is in a lower position.

Figure 7:
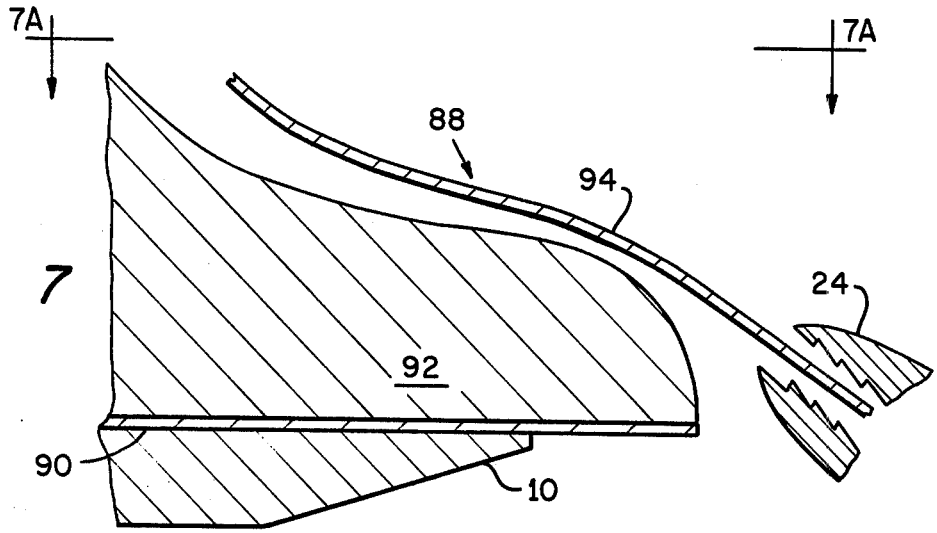
FIG. 7 is a representation of a shoe assembly in the machine at the beginning of the machine cycle.
Figure 7A:
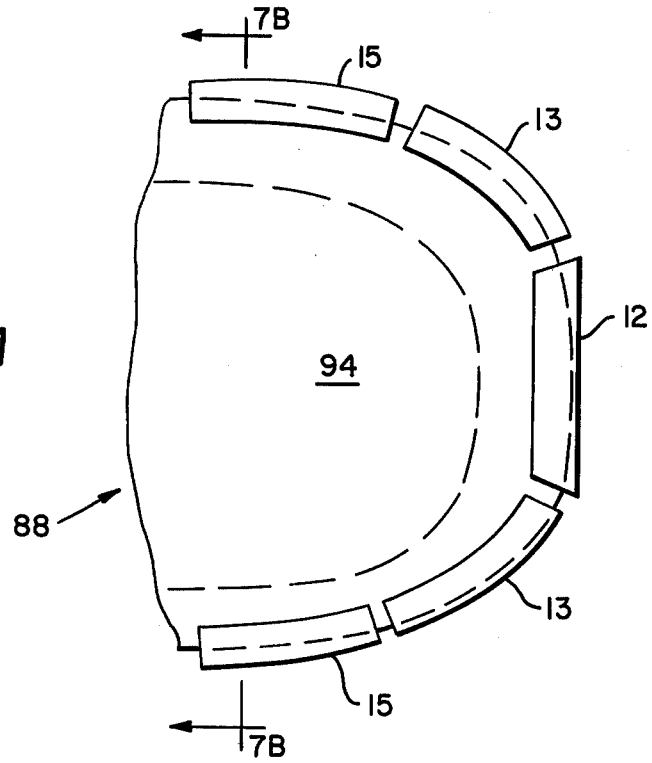
FIG. 7A is a view taken along the line 7A—7A of FIG. 7.
Figure 7B:
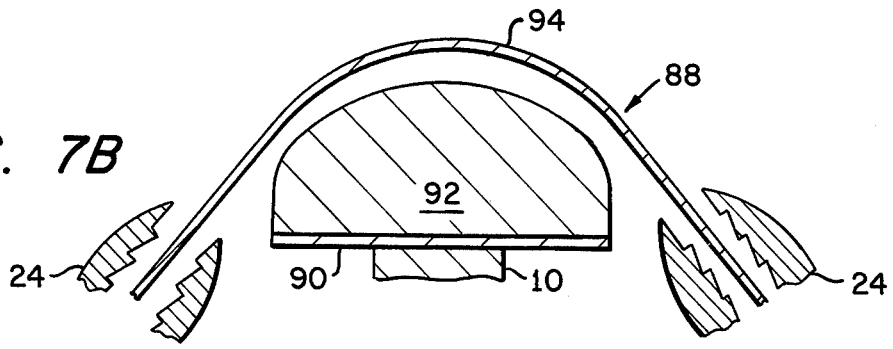
FIG. 7B is a view taken along the line 7B—7B of FIG. 7A.
Figure 8:
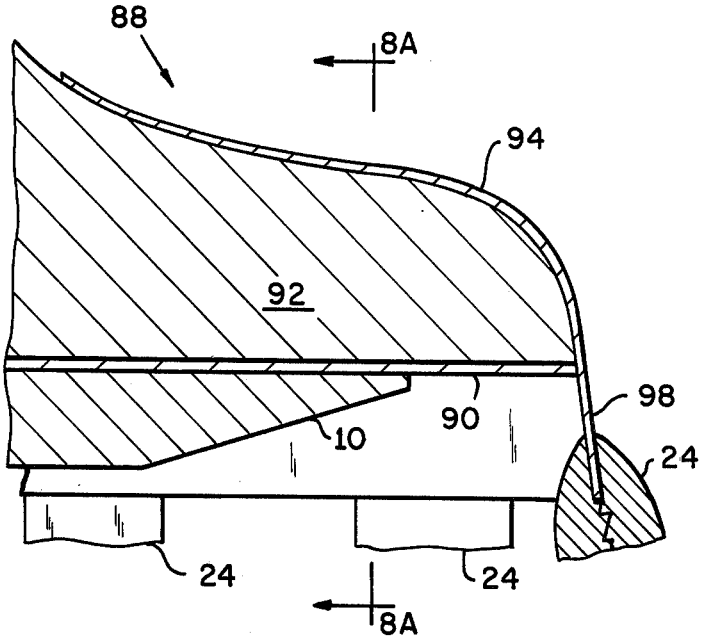
FIG. 8 is a representation of the shoe assembly in the machine after the pincers have stretched the upper about the toe portion of the last.
Figure 8A:
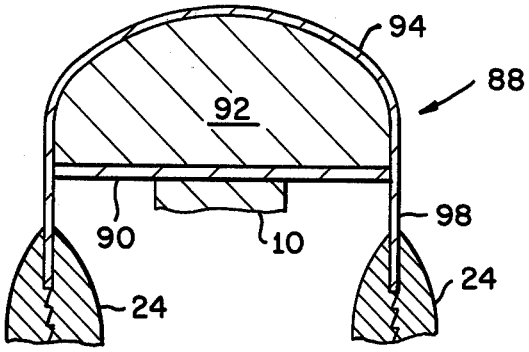
FIG. 8A is a section taken along the line 8A—8A of FIG. 8.

Referring to FIGS. 7, 7A and 7B, a shoe assembly 88 is presented bottom-down to the machine. The shoe assembly 88 comprises a shoe insole 90 located on the bottom of a last 92 and a shoe upper 94 draped over the last. The insole 90 is placed by the operator against the insole rest 10, which thus constitutes a shoe assembly support. At this time, with the machine in its idle condition, all of the pincers 24 are located above the insole 90. The operator inserts the margin of the upper between the open pincers jaws of the pincers 24 of all of the pincers assemblies and all of the motors 30 are actuated to raise their shafts 34 to thereby cause all of the pincers 24 to grip the upper margin. This is followed by an actutation of the motor 80 to raise the piston 82, together with the insole rest 10, while the upper margin is gripped by the pincers 24 of all of the pincers assemblies 12, 13 and 15, to thereby cause the upper 94 to be stretched about the vamp of the last 92 as indicated in FIGS. 8 and 8A. After the insole rest 10 has completed its rise, a heel clamp 96 (FIG. 1) is moved rearwardly to bear against the heel end of the shoe assembly and the motors 66 are actuated to retract their piston rods 68. The retractions of the piston rods 68 causes the cams 72 to force the legs 62,64 towards each other and close the brakes 56 whereby the annuli 54 tightly grip the posts 28 to thereby enable the posts 28 and the sleeves 52 to move heightwise in unison. Shortly after these actuations of the motors 66, the motors 74 are actuated to raise their piston rods 76 under relatively low pressure.

It is desirable, when the parts are in the FIGS. 8 and 8A position, that the upper margin 98 be stretched uniformly about the last 92 with the upper margin 98 extending substantially uniform distances downwardly of the insole 90 for the below described wiping operation. Should the upper margin 98 not be so disposed after the insole rest 10 has completed its rise, the operator may selectively manipulate one or more of the handles 48 to selectively force down desired ones of the pincers 24 against the upwardly directed forces imparted by the motors 18 to correct the disposition of the upper margin 98. A manipulation of a selected handle 48 causes a unitary rotation of its associated bar 46, links 42 and 44, and pin 40 counterclockwise (FIG. 3) about the axis of the pin 40 to thereby cause the associated links 50 and the associated sleeve 52 and annulus 54 to move downwardly. Due to the gripping action of the annulus 54 on the post 28, the downward movement of the annulus 54 causes corresponding downward movement of its associated post 28, its assoicated sleeve 22, and its associated pincers 24 against the upwardly directed force imparted by its associated motor 18.

The links 44, 78 form a toggle 100 (FIGS. 2 and 3) and the rotation of a handle 48 causes the associated toggle 100 to break by causing the associated link 44 to swing counterclockwise (FIG. 3) about the axis of its associated pin 40 with the associated link 78 swinging clockwise (FIG. 3) about its associated pin 77, as indicated in phantom in FIG. 3, with the associated piston rod 76 rising accordingly. The upwardly directed relatively low pressure force applied to the associated piston rod 76 by the associated motor 74 enables the associated toggle 100 to remain in this broken position after the associated handle 48 has been released by the operator. Therefore, the operator may selectively rotate desired handles 48 to selectively lower corresponding pincers 24 distances that correspond to the extent of rotation of the handles 48 with the lowered pincers remaining in their lowered positions after the operator has released the handles.

Figure 9:
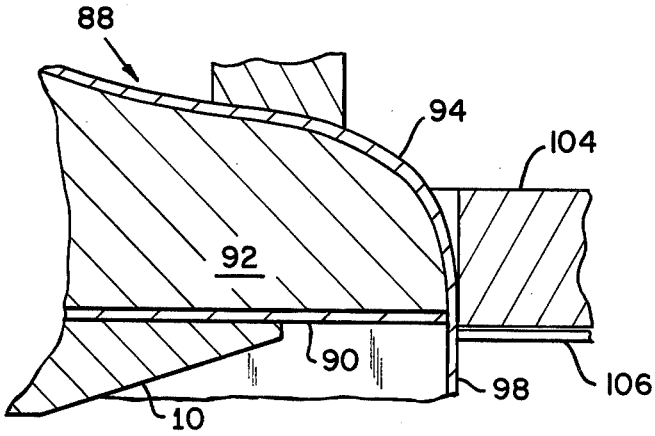
FIG. 9 is a representation of the shoe assembly in the machine immediately before the wiping stroke.

The remainder of the machine cycle is similar to that of the machines disclosed in U.S. Pat. No. 3,902,211 and British patent specification number 1341967. The machine includes a slide plate, constructed similarly to the slide plate shown in U.S. Pat. No. 3,397,417, which carries a toe pad 104 and toe wipers 106 (FIG. 1). The machine parts are now brought into position shown in FIG. 9 wherein the slide plate has been moved forwardly from its initial rearward position to cause the toe pad 104 to press the toe portion of the upper 94 against the last 92 and to bring the wipers 106 into a position of readiness for toe wiping. By the time the machine parts are in the FIG. 9 position, an adhesive applicator 108 (FIG. 1) has been raised against the insole 90, adhesive has been extruded from the applicator 108 onto the margin of the toe portion of the insole and the applicator has been lowered away from the insole 90. Also, by the time the machine parts are in the FIG. 9 position, the motors 30 of the toe pincers assembly 12 and of the corner pincers assemblies 13 have been actuated to lower their associated shafts 34 to thus enable the pincers 24 of these pincers assemblies to open and release the upper margin 98.

Now a wiping stroke is imparted to the wipers 106 to cause the wipers to move forwardly and inwardly, in the manner shown in U.S. Pat. No. 3,397,417, so as to engage the toe portion of the upper margin 98, wipe or fold the upper margin against the insole 90, and bond the wiped upper margin to the insole by means of the previously applied adhesive. During the wiping stroke:

a. The motors 66 are actuated to project their piston rods 68 to their idle positions to reopen the brakes 56 and thereby again permit relative heightwise movement between the sleeves 52 and the posts 28;
b. The motors 74 are actuated to lower the piston rods 76 to thereby return the links 44 and 78 of those toggles 100 that have been broken by manipulation of their associated handles 48 to their idle positions of alignment.
c. The motors 30 of the forepart pincers assemblies 15 are actuated to raise their associated shafts 34 to thereby enable the pincers 24 of these pincers assemblies to open and release the upper margin 98; and
d. The motors 18 of all of the pincers assemblies 12, 13 and 15 are actuated to lower their pistons 20 and their associated posts 28 and sleeves 22 to thereby lower all of the pincers 24 out of the path of the oncoming wipers 106.

The brakes 56 are opened by the motors 66 before the pincers 24 are lowered by the motors 18 so that the lowering of the posts 22 does not cause movement of the handles 48. The return of the links 44,78 of those toggles 100 that had been broken by manipulation of their associated handles 48 to their aligned positions causes such handles to return to their idle positions. Thus it can be seen that the handles 48 are moved only a relatively small amount when maniupulated by the operator to lower selected pincers 24 as described above and the handles that are so moved are automatically returned to their idle positions at or before the end of the machine cycle. This is contrasted with the prior art arrangement, referred to above, wherein the handles are so connected to the pincers lowering means as to be moved a relatively large amount when the pincers are lowered to be moved out of the path of the wipers.

At the completion of the wiping stroke, the machine parts are returned to their idle positions and the toe lasted shoe assembly is removed from the machine. During the return of the machine parts to their idle positions, the motors 18 are actuated to raise the piston 20 and their associated posts 28 and sleeves 22 to thereby raise all of the pincers 24 to their idle positions. Since the brakes 56 are open at this time, the raising of the posts 22 does not cause movement of the handles 48.

There follows a recapitalution of the machine and its mode of operation as they pertain to this invention.

The pulling over mechanism comprises pincers 24 mounted for heightwise movement between upper and lower positions. The motor 18 constitutes powered means for effecting this heightwise movement. The control for the motor 18 placing its piston 20 in its raised position constitutes means for initially causing the powered means 18 to retain the pincers 24 in its upper position. The handle 48 is so mounted as to be movable away from an idle position. The members 46, 42, 50, 52, 54, 28 and 22 constitute connecting means so connecting the handle 48 to the pincers 24 as to cause the pincers 24 to be lowered from its upper position to an intermediate position in response to movement of the handle from its idle position to an advanced position, the distance between the pincers upper position and the pincers intermediate position being proportional to the extent of movement of the handle 48 away from its idle position to its advanced position. The members 44, 74, 76 and 78 constitute retaining means enabling the pincers 24 to be retained in its intermediate position upon release of the handle in its advanced position. The controls of the motor 18 lowering and raising the piston 20 respectively constitutes means for thereafter actuating the powered means 18 to lower the pincers 24 from its intermediate position to its lower position and to thereafter raise the pincers 24 from its lower position to its upper position. The brake 56 constitutes release means operative to release the connecting means after the handle 48 has been moved to its advanced position and prior to the actuation of the powered means 18 to lower the pincers 24 from its intermediate position to its lower position. The members 44, 74, 76 and 78 constitute return means operative to return the handle 48 to its idle position after the connecting means has been released.

The pulling over mechanism further comprises the post 28 so connected to the powered means 18 and to the pincers 24 as to cause the post 28 to move heightwise in unison with the pincers 24. The connecting means and the release means comprise: the sleeve 52 mounted for heightwise movement; the brake 56, movable between open and closed positions, mounted for heighwise movement with the sleeve 52; the brake 56 being so constructed as to permit heightwise movement of the sleeve 52 with respect to the post 28 when the brake 56 is in its open position and to preclude heightwise movement of the sleeve 52 with respect to the post 28 when the brake 56 is in its closed position; and the linkage fromed by the members 50, 42 and 46 so connecting the sleeve 52 to the handle 48 as to move the sleeve 52 heightwise in response to movement of the handle 48.

The retaining means comprises: the upper toggle link 44 and the lower toggle link 48 that are pivoted to each other; the rod 76, mounted for heightwise movement, that is pivoted to the lower toggle link 78; a connection, formed by the bar 46, between the upper toggle link 44 and the handle 48 so constructed as to maintain the toggle link 44, 78 in alignment when the handle 48 is in its idle position and as to move the toggle links 44, 78 to a broken position of nonalignment pursuant to the movement of the handle 48 from its idle position to its advanced position; and the control for the motor 74 that moves the rod 76 upwardly which constitutes means for yieldably urging the rod 76 upwardly under a relatively low force to retain the toggle links 44, 78 in their broken position upon release of handle 48. The release means comprises the control for the motor 74 that moves the rod 76 downwardly which constitutes means for forcing the rod 76 downwardly to move the toggle links 44,78 back to their position of alignment.

The linkage connecting the sleeve 52 to the handle 48 comprises: the rotatably mounted bar 46 connected to the handle 48; a link 42, which constitutes a first link, connected to the bar 46 for unitary rotation therewith; and the link 50, which constitutes a second link, pivotally connected to the first link 42 and pivotally connected to the sleeve 52. The upper toggle link 44 is connected to the bar 46 for unitary rotation therewith.

I claim:

1. A pulling over mechanism comprising: a pincers mounted for heightwise movement between upper and lower positions; powered means for effecting said heightwise movement; means for initially causing the powered means to retain the pincers in its upper position; a handle so mounted as to be movable away from an idle position; connecting means so connecting the handle to the pincers as to cause the pincers to be lowered from its upper position to an intermediate position in response to movement of the handle from its idle position to an advanced position, the distance between the pincers upper position and the pincers intermediate position being proportional to the extent of movement of the handle away from its idle position to its advanced position; retaining means enabling the handle to be retained in its advanced position and therefore enabling the pincers to be retained in its intermediate position upon release of the handle in its advanced position; means for thereafter actuating the powered means to lower the pincers from its intermediate position to its lower position; and means for thereafter actuating the powered means to raise the pincers from its lower position to its upper position; characterized in that the machine comprises: release means operative to release said connecting means after the handle has been moved to its advanced position and prior to the actuation of the powered means to lower the pincers from its intermediate position to its lower position; and return means operative to thereafter return the handle to its idle position.

2. The mechanism of claim 1 further comprising: a post so connected to the powered means and to the pincers as to cause the post to move heightwise in unison with the pincers; and characterized in that said connecting means and release means comprise: a sleeve mounted for heightwise movement; a brake, movable between open and closed positions, mounted for heightwise movement with the sleeve; the brake being so constructed as to permit heightwise movement of the sleeve with respect to the post when the brake is in its open position and to preclude heightwise movement of the sleeve with respect to the post when the brake is in its closed position; and a linkage so connecting the sleeve to the handle as to move the sleeve heightwise in response to movement of the handle.

3. The mechansim of claim 1 or claim 2 characterized in that said retaining means comprises: an upper toggle link and a lower toggle link pivoted to each other; a rod, mounted for heightwise movement, pivoted to the bottom of the lower toggle link; a connection between the upper toggle link and the handle so constructed as to maintain the toggle links in alignment when the handle is in its idle position and as to move the toggle links to a broken position of non-alignment pursuant to the movement of the handle from its idle position to its advanced position; and means for yieldably urging the rod upwardly under a relatively low force to retain the toggle links in their broken position upon release of the handle; and characterized in that said return means comprises: means for forcing the rod downwardly to move the toggle links back to their position of alignment.

4. The mechanism of claim 2 characterized in that said linkage comprises: a rotatably mounted bar connected to the handle; a first link connected to the bar for unitary rotation therewith; and a second link pivotally connected to the first link and pivotally connected to the sleeve; characterized in that said retaining means comprises: an upper toggle link connected to the bar for unitary rotation therewith; a lower toggle link pivoted to the upper toggle link; a rod, mounted for heightwise movement, pivoted to the bottom of the lower toggle link; the toggle links being so constructed and arranged that they are maintained in alignment when the handle is in its idle position and are rotated by the bar to a broken position of non-alignment pursuant to the movement of the handle from its idle position to its advanced position; and means for yieldably urging the rod upwardly under a relatively low force to retain the toggle links in their broken position upon release of the handle; and characterized in that said return means comprises: means for forcing the rod downwardly to move the toggle links back to their position of alignment.

* * * * *

UNITED STATES PATENT AND TRADEMARK OFFICE

CERTIFICATE OF CORRECTION

PATENT NO. : 4155135

DATED : May 22, 1979

INVENTOR(S) : Michael M. Becka

It is certified that error appears in the above-identified patent and that said Letters Patent are hereby corrected as shown below:

Column 1: line 66, change "by providing" to --provides--.
Column 5, line 55 and column 6, line 11: change "22" to --28--.
Column 7: line 11, change "release" to --return--.

Signed and Sealed this

*Twentieth* Day of *January 1981*

[SEAL]

*Attest:*

RENE D. TEGTMEYER

*Attesting Officer*

*Acting Commissioner of Patents and Trademarks*